US009024964B2

(12) United States Patent
Ng

(10) Patent No.: US 9,024,964 B2
(45) Date of Patent: May 5, 2015

(54) SYSTEM AND METHOD FOR DITHERING VIDEO DATA

(75) Inventor: Sunny Yat-san Ng, Cupertino, CA (US)

(73) Assignee: OmniVision Technologies, Inc., Santa Clara, CA (US)

( * ) Notice: Subject to any disclaimer, the term of this patent is extended or adjusted under 35 U.S.C. 154(b) by 773 days.

(21) Appl. No.: 12/157,190

(22) Filed: Jun. 6, 2008

(65) Prior Publication Data

US 2009/0303248 A1 Dec. 10, 2009

(51) Int. Cl.

| | |
|---|---|
| ***G09G 5/02*** | (2006.01) |
| ***G09G 3/20*** | (2006.01) |
| *G09G 3/36* | (2006.01) |

(52) U.S. Cl.

CPC ..... *G09G 3/2055* (2013.01); *G09G 3/3611* (2013.01); *G09G 2320/0276* (2013.01); *G09G 2340/0428* (2013.01)

(58) Field of Classification Search

USPC ..... 345/204–215, 690–693, 98, 100, 600, 345/603, 596

See application file for complete search history.

(56) References Cited

U.S. PATENT DOCUMENTS

| | | | |
|---|---|---|---|
| 4,591,842 | A | 5/1986 | Clarke, Jr. et al. |
| 4,745,475 | A | 5/1988 | Bicknell |
| 4,951,229 | A | 8/1990 | DiNicola et al. |
| 5,285,214 | A | 2/1994 | Bowry |
| 5,497,172 | A | 3/1996 | Doherty et al. |
| 5,570,297 | A | 10/1996 | Brzezinski et al. |
| 5,598,188 | A | 1/1997 | Gove et al. |
| 5,602,559 | A | 2/1997 | Kimura |
| 5,619,228 | A | 4/1997 | Doherty |
| 5,668,611 | A | 9/1997 | Ernstoff et al. |

(Continued)

FOREIGN PATENT DOCUMENTS

| | | | |
|---|---|---|---|
| CN | 1155136 | A | 7/1997 |
| EP | 0698874 | A1 | 2/1996 |

(Continued)

OTHER PUBLICATIONS

U.S. Appl. No. 11/154,984, Office Action dated Feb. 27, 2008.

(Continued)

*Primary Examiner* — James A Thompson

(74) *Attorney, Agent, or Firm* — Larry E. Henneman, Jr.; Gregory P. Gibson; Henneman & Associates, PLC

(57) ABSTRACT

A novel method for driving a display device includes the steps of receiving video data of a first type, converting the video data to data of a second type, dithering the data of the second type to form dithered pixel data, and outputting the dithered pixel data. The step of converting the video data to data of a second type includes inserting dither bits indicative of a particular dithering scheme into the data of the second type. An example display driver circuit includes an input for receiving video data, a data converter coupled to receive the video data and operative to convert the video data into pixel data to be written to pixels of a display, and a ditherer operative to receive the pixel data and to dither the pixel data to generate dithered pixel data. The video data is data of a first type, and the pixel data is data of a second type, different from the first type. In the disclosed example, the first type of data includes a binary data word, and the second type of data includes a compound data word. The compound data word includes a first set of binary weighted bits, a second set of arbitrarily weighted bits, and dither bits.

22 Claims, 8 Drawing Sheets

(56) References Cited

U.S. PATENT DOCUMENTS

| | | | | |
|---|---|---|---|---|
| 5,677,703 | A | 10/1997 | Bhuva et al. | |
| 5,680,156 | A | 10/1997 | Gove et al. | |
| 5,731,802 | A | 3/1998 | Aras et al. | |
| 5,748,164 | A | 5/1998 | Handschy et al. | |
| 5,757,347 | A | 5/1998 | Han | |
| 5,767,818 | A | 6/1998 | Nishida | |
| 5,940,142 | A | 8/1999 | Wakitani et al. | |
| 5,969,710 | A | 10/1999 | Doherty et al. | |
| 5,986,640 | A | 11/1999 | Baldwin et al. | |
| 6,005,591 | A | 12/1999 | Ogura et al. | |
| 6,008,785 | A | 12/1999 | Hewlett et al. | |
| 6,072,452 | A | 6/2000 | Worley, III et al. | |
| 6,100,939 | A | 8/2000 | Kougami et al. | |
| 6,140,983 | A | 10/2000 | Quanrud | |
| 6,144,356 | A | 11/2000 | Weatherford et al. | |
| 6,144,364 | A | 11/2000 | Otobe et al. | |
| 6,151,011 | A | 11/2000 | Worley, III et al. | |
| 6,175,355 | B1 | 1/2001 | Reddy | |
| 6,201,521 | B1 | 3/2001 | Doherty | |
| 6,215,466 | B1 | 4/2001 | Yamazaki et al. | |
| 6,232,963 | B1 | 5/2001 | Tew et al. | |
| 6,246,386 | B1 | 6/2001 | Perner | |
| 6,295,054 | B1 | 9/2001 | McKnight | |
| 6,326,980 | B1 | 12/2001 | Worley, III | |
| 6,353,435 | B2 | 3/2002 | Kudo et al. | |
| 6,388,661 | B1 | 5/2002 | Richards | |
| 6,441,829 | B1 | 8/2002 | Blalock et al. | |
| 6,518,977 | B1 | 2/2003 | Naka et al. | |
| 6,636,206 | B1 | 10/2003 | Yatabe | |
| 6,639,602 | B1 | 10/2003 | Fukushima et al. | |
| 6,771,240 | B2 | 8/2004 | Inoue et al. | |
| 6,809,717 | B2 | 10/2004 | Asao et al. | |
| 6,833,832 | B2 | 12/2004 | Wolverton | |
| 6,864,643 | B2 | 3/2005 | Min et al. | |
| 6,873,308 | B2 | 3/2005 | Sagano et al. | |
| 6,903,516 | B2 | 6/2005 | Tanada | |
| 6,965,357 | B2 | 11/2005 | Sakamoto et al. | |
| 6,972,773 | B2 | 12/2005 | Matsui et al. | |
| 6,982,722 | B1 * | 1/2006 | Alben et al. | 345/596 |
| 6,985,164 | B2 | 1/2006 | Rogers et al. | |
| 7,071,905 | B1 | 7/2006 | Fan | |
| 7,098,927 | B2 * | 8/2006 | Daly et al. | 345/596 |
| 7,172,297 | B2 | 2/2007 | Whitehead et al. | |
| 7,184,035 | B2 | 2/2007 | Sato et al. | |
| 7,196,683 | B2 | 3/2007 | Yamamoto et al. | |
| 7,274,363 | B2 | 9/2007 | Ishizuka et al. | |
| 7,301,518 | B2 | 11/2007 | Hosaka | |
| 7,317,464 | B2 | 1/2008 | Willis | |
| 7,391,398 | B2 * | 6/2008 | Inoue | 345/89 |
| 7,471,273 | B2 | 12/2008 | Hewlett et al. | |
| 7,499,065 | B2 | 3/2009 | Richards | |
| 7,545,396 | B2 | 6/2009 | Ng | |
| 7,580,047 | B2 | 8/2009 | Ng | |
| 7,580,048 | B2 | 8/2009 | Ng | |
| 7,580,049 | B2 | 8/2009 | Ng | |
| 7,605,831 | B2 | 10/2009 | Ng | |
| 7,692,671 | B2 | 4/2010 | Ng | |
| 7,903,123 | B1 * | 3/2011 | Alben et al. | 345/596 |
| 8,199,163 | B2 * | 6/2012 | Choi et al. | 345/600 |
| 2001/0020951 | A1 | 9/2001 | Onagawa | |
| 2002/0018054 | A1 | 2/2002 | Tojima et al. | |
| 2002/0018073 | A1 * | 2/2002 | Stradley et al. | 345/698 |
| 2002/0085438 | A1 | 7/2002 | Wolverton | |
| 2002/0135553 | A1 | 9/2002 | Nagai et al. | |
| 2002/0145585 | A1 | 10/2002 | Richards | |
| 2003/0034948 | A1 | 2/2003 | Imamura | |
| 2003/0048238 | A1 | 3/2003 | Tsuge et al. | |
| 2003/0063107 | A1 * | 4/2003 | Thebault et al. | 345/690 |
| 2003/0151599 | A1 | 8/2003 | Bone | |
| 2003/0210257 | A1 | 11/2003 | Hudson et al. | |
| 2004/0080516 | A1 * | 4/2004 | Kurumisawa et al. | 345/596 |
| 2004/0113879 | A1 | 6/2004 | Sekiguchi et al. | |
| 2004/0125117 | A1 * | 7/2004 | Suzuki et al. | 345/690 |
| 2004/0150596 | A1 | 8/2004 | Uchida et al. | |
| 2004/0150602 | A1 * | 8/2004 | Furukawa et al. | 345/98 |
| 2004/0218334 | A1 | 11/2004 | Martin et al. | |
| 2004/0239593 | A1 | 12/2004 | Yamada | |
| 2004/0239606 | A1 | 12/2004 | Ota | |
| 2005/0062709 | A1 | 3/2005 | Zeiter et al. | |
| 2005/0062765 | A1 | 3/2005 | Hudson | |
| 2005/0110720 | A1 | 5/2005 | Akimoto et al. | |
| 2005/0110808 | A1 * | 5/2005 | Goldschmidt et al. | 345/690 |
| 2005/0110811 | A1 * | 5/2005 | Lee et al. | 345/690 |
| 2006/0001613 | A1 | 1/2006 | Routley et al. | |
| 2006/0017746 | A1 | 1/2006 | Weithbruch et al. | |
| 2006/0044325 | A1 | 3/2006 | Thebault et al. | |
| 2006/0066645 | A1 | 3/2006 | Ng | |
| 2006/0181653 | A1 * | 8/2006 | Morgan | 348/771 |
| 2006/0267896 | A1 | 11/2006 | Edwards | |
| 2007/0008252 | A1 | 1/2007 | Seki | |
| 2007/0091042 | A1 * | 4/2007 | Chung et al. | 345/88 |
| 2008/0100639 | A1 * | 5/2008 | Pettitt et al. | 345/589 |
| 2008/0158263 | A1 * | 7/2008 | Hui et al. | 345/690 |
| 2008/0259019 | A1 | 10/2008 | Ng | |
| 2009/0027360 | A1 | 1/2009 | Kwan et al. | |
| 2009/0027361 | A1 | 1/2009 | Kwan et al. | |
| 2009/0027362 | A1 | 1/2009 | Kwan et al. | |
| 2009/0027363 | A1 | 1/2009 | Kwan et al. | |
| 2009/0027364 | A1 | 1/2009 | Kwan et al. | |
| 2009/0303206 | A1 | 12/2009 | Ng | |
| 2009/0303207 | A1 | 12/2009 | Ng | |
| 2009/0303248 | A1 * | 12/2009 | Ng | 345/596 |
| 2010/0091004 | A1 | 4/2010 | Yat-san Ng | |
| 2010/0259553 | A9 * | 10/2010 | Van Belle | 345/597 |

FOREIGN PATENT DOCUMENTS

| | | | |
|---|---|---|---|
| EP | 0720139 | A2 | 7/1996 |
| EP | 0762375 | A2 | 3/1997 |
| EP | 0774745 | B1 | 5/1997 |
| EP | 1937035 | A2 | 6/2008 |
| JP | 08-063122 | A | 3/1996 |
| JP | 08-511635 | A | 12/1996 |
| JP | 09-034399 | A | 2/1997 |
| JP | 09-083911 | A | 3/1997 |
| JP | 09-212127 | A | 8/1997 |
| JP | 09-258688 | A | 10/1997 |
| JP | 10-31455 | A | 2/1998 |
| TW | 228575 | | 8/1994 |
| TW | 316307 | | 9/1997 |
| TW | 413786 | | 12/2000 |
| TW | 507182 | | 10/2002 |
| TW | 511050 | | 11/2002 |
| TW | 525139 | | 3/2003 |
| TW | 533392 | | 5/2003 |
| TW | 544645 | B | 8/2003 |
| TW | 544650 | | 8/2003 |
| TW | 544650 | B | 8/2003 |
| TW | 580666 | | 3/2004 |
| TW | 582005 | | 4/2004 |
| TW | 2004/07816 | A | 5/2004 |
| TW | I221599 | | 10/2004 |
| WO | WO 94/09473 | A1 | 4/1994 |
| WO | WO 95/27970 | A1 | 10/1995 |
| WO | WO 97/40487 | A1 | 10/1997 |
| WO | WO 99/44188 | A1 | 9/1999 |

OTHER PUBLICATIONS

U.S. Appl. No. 11/154,984, Office Action dated Oct. 15, 2008.
U.S. Appl. No. 11/154,984, Notice of Allowance dated Jan. 27, 2009.
PCT Application No. PCT/US2006/020096, International Search Report and Written Opinion dated Oct. 9, 2007.
PCT Application No. PCT/US2006/020096, International Preliminary Report on Patentability dated Jan. 3, 2008.
TW Application No. 095118593, Office Action dated Jul. 27, 2011 (English translation).
U.S. Appl. No. 11/171,496, Office Action dated Feb. 27, 2008.
U.S. Appl. No. 11/171,496, Office Action dated Dec. 19, 2008.
U.S. Appl. No. 11/171,496, Notice of Allowance dated Apr. 3, 2009.
U.S. Appl. No. 11/172,622, Office Action dated Sep. 24, 2008.
U.S. Appl. No. 11/172,622, Notice of Allowance dated Jun. 8, 2009.
U.S. Appl. No. 11/172,621, Office Action dated Sep. 15, 2008.

(56) References Cited

OTHER PUBLICATIONS

U.S. Appl. No. 11/172,621, Notice of Allowance dated Apr. 17, 2009.
U.S. Appl. No. 11/172,382, Office Action dated Sep. 2, 2008.
U.S. Appl. No. 11/172,382, Office Action dated Apr. 10, 2009.
U.S. Appl. No. 11/172,382, Notice of Allowance dated Nov. 18, 2009.
U.S. Appl. No. 11/172,623, Office Action dated Sep. 23, 2008.
U.S. Appl. No. 11/172,623, Notice of Allowance dated Apr. 16, 2009.
U.S. Appl. No. 12/077,536, filed Mar. 19, 2008 by Ng, Notice of Allowability dated Aug. 24, 2012.
U.S. Appl. No. 11/881,732, filed Jul. 27, 2007 by Kwan et al., Supplemental Notice of Allowability dated Jun. 15, 2012.
U.S. Appl. No. 12/011,606, filed Jan. 28, 2008 by Kwan et al., Supplemental Notice of Allowability dated Jun. 15, 2012.
U.S. Appl. No. 12/011,604, filed Jan. 28, 2008 by Kwan et al., Supplemental Notice of Allowability dated Jun. 26, 2012.
U.S. Appl. No. 12/011,520, filed Jan. 28, 2008 by Kwan et al., Supplemental Notice of Allowability dated Jul. 12, 2012.
U.S. Appl. No. 12/011,605, filed Jan. 28, 2008 by Kwan et al., Supplemental Notice of Allowability dated Jun. 26, 2012.
JP Application No. 2010-226942, filed Oct. 6, 2010 by Worley et al., Office Action dated Jan. 7, 2013.
JP Application No. 2010-226942, filed Oct. 6, 2010 by Worley et al., Office Action dated Jul. 1, 2013.
TW Application No. 101101477, filed Jan. 13, 2012, by OmniVision Technologies, Inc., Decision for Invention Patent Application (Notice of Allowance) dated May 23, 2014.
TW Application No. 101101476, filed Jan. 13, 2012, by OmniVision Technologies, Inc., Decision for Invention Patent Application (Notice of Allowance) dated Jun. 27, 2014.
TW Application No. 101101474, filed Jan. 13, 2012, by OmniVision Technologies, Inc., Decision for Invention Patent Application (Notice of Allowance) dated Jun. 25, 2014.
TW Application No. 101101471, filed Jan. 13, 2012, by OmniVision Technologies, Inc., Decision for Invention Patent Application (Notice of Allowance) dated Jul. 30, 2014.
*An Overview of Flaws in Emerging Television Displays and Remedial Video Processing*, Gerard de Haan and Michiel A. Klompenhouwer, IEEE Transactions on Consumer Electronics, Aug. 2001, vol. 47, pp. 326-334.
U.S. Appl. No. 09/032,174, Office Action dated Dec. 20, 1999.
U.S. Appl. No. 09/032,174, Notice of Allowance dated Jun. 2, 2000.
PCT Application Serial No. PCT/US1999/003847, International Search Report dated Jun. 16, 1999.
PCT Application Serial No. PCT/US1999/003847, Written Opinion dated Mar. 1, 2000.
PCT Application Serial No. PCT/US1999/003847, International Preliminary Examination Report dated Jul. 11, 2000.
CA Application Serial No. 2,322,510, Office Action dated Oct. 13, 2006.
CA Application Serial No. 2,322,510, Office Action dated Sep. 4, 2007.
CA Application Serial. No. 2,322,510, Notice of Allowance dated Sep. 11, 2008.
CN Application Serial No. 99805193.4, Office Action dated Jan. 16, 2004. (English translation).
CN Application Serial. No. 99805193.4, Office Action dated Aug. 6, 2004. (English translation).
CN Application Serial No. 99805193.4, Notice of Allowance dated Apr. 29, 2005. (English translation).
EP Application Serial No. 99 936 139.7, Office Action dated Jul. 24, 2007.
EP Application Serial No. 99 936 139.7, Office Action dated Sep. 28, 2009.
EP Application Serial No. 99 936 139.7, Notice of Abandonment dated May 17, 2010.
JP Application Serial No. 2000-533866, Office Action dated Sep. 15, 2009. (English translation).
JP Application Serial No. 2000-533866, Office Action dated Apr. 7, 2010. (English translation).
JP Application Serial No. 2000-533866, Office Action dated Nov. 1, 2010. (English translation).
U.S. Appl. No. 11/881,732, Office Action dated Aug. 22, 2011.
U.S. Appl. No. 11/881,732, Interview Summary dated Feb. 23, 2012.
U.S. Appl. No. 11/881,732, Notice of Allowance dated May 3, 2012.
U.S. Appl. No. 12/011,606, Office Action dated Feb. 17, 2012.
U.S. Appl. No. 12/011,606, Interview Summary dated Feb. 23, 2012.
U.S. Appl. No. 12/011,606, Notice of Allowance dated May 4, 2012.
U.S. Appl. No. 12/011,604, Office Action dated Feb. 14, 2012.
U.S. Appl. No. 12/011,604, Interview Summary dated Feb. 23, 2012.
U.S. Appl. No. 12/011,604, Interview Summary dated May 4, 2012.
U.S. Appl. No. 12/011,604, Notice of Allowance dated May 4, 2012.
U.S. Appl. No. 12/011,520, Office Action dated Oct. 7, 2011.
U.S. Appl. No. 12/011,520, Interview Summary dated Feb. 23, 2012.
U.S. Appl. No. 12/011,520, Notice of Allowance dated May 3, 2012.
U.S. Appl. No. 12/011,605, Office Action dated Oct. 7, 2011.
U.S. Appl. No. 12/011,605, Interview Summary dated Feb. 24, 2012.
U.S. Appl. No. 12/011,605, Notice of Allowance dated May 4, 2012.
U.S. Appl. No. 12/157,166, Office Action dated Jul. 8, 2011.
U.S. Appl. No. 12/157,166, Office Action dated Dec. 23, 2011.
U.S. Appl. No. 12/157,166, Interview Summary dated Feb. 22, 2012.
U.S. Appl. No. 12/157,166, Notice of Allowance dated May 11, 2012.
U.S. Appl. No. 12/157,189, Office Action dated Jul. 7, 2011.
U.S. Appl. No. 12/157,189, Office Action dated Dec. 29, 2011.
U.S. Appl. No. 12/157,189, Interview Summary dated Feb. 23, 2012.
U.S. Appl. No. 12/157,189, Notice of Allowance dated May 17, 2012.
U.S. Appl. No. 10/949,703, Office Action dated Aug. 14, 2009.
U.S. Appl. No. 10/949,703, Notice of Abandonment dated Mar. 1, 2010.
U.S. Appl. No. 12/077,536, Office Action dated Jan. 5, 2012.

* cited by examiner

SYSTEM AND METHOD FOR DITHERING VIDEO DATA

BACKGROUND OF THE INVENTION

1. Field of the Invention

The present invention relates generally to processes for driving image display devices, and more particularly to an improved system and method for dithering video data. Even more particularly, the present invention relates to a system and method for dithering video data to be displayed on a display including an array of individual pixel cells.

2. Description of the Background Art

In recent years the demand for flat panel image/video displays has drastically increased, mainly because the overall volume and weight is significantly less than that of traditional CRT (cathode ray tube) displays of equivalent screen area. In addition, flat panel display devices are used in other applications unsuitable for conventional CRTs, for example in high resolution video projection systems. Examples of flat panel displays used in video projection systems include, but are not limited to, liquid crystal on silicon (LCOS) and deformable mirror devices (DMDs).

Today digital displays (e.g., LCDs) are common. When driving digital LCDs, the pixel is driven in one of two states: an "on" state or an "off" state. During the "on" state a saturation voltage potential is applied across the liquid crystal layer which results in the maximum light output (i.e., a light pixel or "on"). Conversely, the "off" state is obtained by applying a threshold voltage potential across the liquid crystal layer which results in the minimum light output (i.e., a dark pixel or "off"). Thus, at any given instant in time, a pixel is either on or off.

Because a digital LCD pixel only has two states, on or off, PWM (pulse width modulation) techniques have been employed so that a single pixel can display what appears to be other intermediate intensities. PWM involves modulating a pixel back and forth between two different states at such a rate the human eye integrates the two intensities to perceive a single intensity. For example, to display what appears to be a single intensity of 10% maximum brightness the "off" state is asserted 90% of the time frame while the "on" state is asserted the other 10% of the time frame. Similarly, to display what appears to be a single intensity of 75% maximum brightness the "off" state is asserted 25% of the time frame while the "on" state is asserted the other 75% of the time frame.

In a similar fashion, a method commonly referred to as dithering is used to display intensities unobtainable by single frame PWM. As an example, a particular type of dithering called temporal dithering is used to display intensity levels that are between the intensity levels that are attainable by PWM. Temporal dithering works similarly to PWM, except that temporal dithering modulates the values attained by PWM. In other words, PWM intensities are attained by modulating 0% and 100% intensities between time slices of a single frame while temporal dithering intensities are attained by modulating these PWM intensities over several frames of data. For example, to display the intermediate pixel value 127.25 on a single pixel, the value 127 is obtained from PWM and displayed three out of every four frames while the value 128 (also obtained from PWM) is displayed once every four frames. As a result, a greater number of intensity levels than defined by the PWM scheme can be achieved.

One problem associated with temporal dithering is that the number of displayable intermediate intensities between the PWM intensities are limited to the number of frames over which the data is dithered. For example, if a cycle includes a series of 10 frames, the only attainable intermediate intensities are tenths. Likewise, if the cycle includes a series of 4 frames, the only attainable intermediate intensities are fourths. For example, if the cycle includes 4 frames, the displayable intermediate intensities between N and N+1 are 1.25N, 1.5N, and 1.75N, N being an arbitrary intensity value defined by the PWM scheme, and N+1 being the next intensity value defined by the PWM scheme. Note that cycle refers to the sequence of frames needed to display a particular intensities.

Another dithering method, commonly known as spatial dithering, involves combining the simultaneous output of a plurality of pixels to achieve intermediate intensity levels. For example, a group of four pixels will appear to have a uniform value of 127.75 if three pixels are illuminated with a value of 128 and the other pixel is illuminated with a value of 127. Similarly, a group of four pixels will appear to have a uniform intensity value of 127.5 if two pixels are illuminated with a value of 127 and the other two pixels are illuminated with a value of 128.

One problem commonly associated with Spatial Dithering is that image resolution is sacrificed for the increase in intensity resolution. This is because it takes multiple pixels to make a single intensity value, rather than just modulating a single pixel to render a single intensity as described for pure temporal dithering. As an example, if an LCD includes groups consisting of four adjacent pixels that render what appears to be a single intensity, the resolution of the entire display will be four times less than it would be if each individual pixel were responsible for a single intensity.

FIG. 1 is a block diagram showing a prior art display driver circuit 100, which is operative to dither video data into planarized display data. In this particular embodiment, display driver circuit 100 includes dithering logic 102, a CLUT (color look up table) 104, and a planarizer 106. Dithering logic 102 receives video data 108 and frame count data 110 from a video data source 112 and frame count source 114, respectively. Further, dithering logic 102 performs dithering operations (e.g., temporal dithering described above) that depend on video data 108 and frame count data 110. Dithering logic 102 then outputs dithered video data 116 that is then received by CLUT 104, where it is mapped or converted to display data 118. Planarizer 106 receives and converts display data 118 into planarized display data 120. A display 122 (e.g., LCD) then receives planarized display data 120 and displays a corresponding intensity.

One problem with prior art circuit 100 is that the number of displayable pixel values are limited by the size of the data word received by the dithering logic. For example, if display driver circuit 100 is driven by 8-bit data words, then only 256 different values can be defined, before modulation techniques are applied. So, the smallest increments between intensity values is limited to the value of data word's LSB (least significant bit). For example, if a dithering logic process adds a bit value to an 8-bit data word, the original value is increased by a value of 1/256 which is approximately 0.3906% of the maximum value.

Another problem is that the electro-optical response curve of the some displays (e.g., LCDs) is not linear. As a result, even if display data can be dithered to precisely achieve an intermediate root-mean-square (RMS) voltage, that RMS voltage may not produce the desired intensity output.

Other known methods for displaying intermediate intensity values involve estimation techniques. However, estimating values leads to noticeable image problems such as the appearance of "steps" or "lines" in contoured images. The appearance of such "steps" is a result of a an estimated intensity value being more different than it's true value than that of an adjacent intensity value being displayed on adjacent pixels.

What is needed, therefore, is a display driving circuit and method capable of more accurately displaying intensity values on a pixel or group of pixels. What is also needed is a display driving circuit and method that eliminates visual artifacts from displayed images.

SUMMARY

The present invention overcomes the problems associated with the prior art by providing a system and method for dithering video data. Video data is converted to a second data type that defines a greater number of intensity levels than the original data and includes dither bits that identify one of a plurality of dithering schemes to be applied to that particular data. The converted data is temporally dithered, and the phase of the temporally dithered data stream is shifted based on the relative location of the pixels to which the data is to be written. The invention facilitates greater accuracy in the reproduction of intensity levels and substantially reduces visual artifacts in displayed data including, but not limited to, flicker and contouring.

A disclosed example display driver circuit includes an input for receiving video data, a data converter coupled to receive the video data and operative to convert the video data into pixel data to be written to pixels of a display, and a ditherer operative to receive the pixel data and to dither the pixel data to generate dithered pixel data. The video data is data of a first type, and the pixel data is data of a second type, different from the first type. In the disclosed example, the first type of data includes a binary data word, and the second type of data includes a compound data word. The compound data word includes a first set of binary weighted bits, including at least one bit, and a second set of arbitrarily weighted bits, also including at least one bit. Optionally, at least some of the arbitrarily weighted bits are equally weighted.

The video data is capable of defining a first number of values, and the pixel data is capable of defining a second number of values, the second number of values being greater than the first number of values. In a disclosed example, the video data includes data words having a first number of bits, and the converted pixel data includes data words having a second number of bits, the second number of bits being greater than the first number of bits. More particularly, in a disclosed example, the video data is binary-weighted video data, and the pixel data includes data words having a group of equally weighted bits. The data words of the pixel data further include a group of binary weighted bits.

The ditherer performs a predetermined dithering function based on at least a portion of the pixel data. For example, the data converter (e.g., a look-up-table) inserts dither bits into the converted pixel data. The dither bits identify a particular one of a plurality of different dither schemes that is to be performed on that particular data word.

A method for driving a display device is also disclosed. An example method includes receiving video data of a first type, converting the first type of video data to data of a second type, dithering the data of said second type to form dithered pixel data, and outputting the dithered pixel data. The step of receiving the video data includes receiving a binary data word indicative of an optical intensity level.

The first type of data is defined by a first data word, and the second type of data is defined by a second data word. The first data word has a least significant bit, and the second data word has a least significant bit. The least significant bit of said second data word is less significant than the least significant bit of the first data word. This facilitates dithering at a finer scale.

Optionally, the step of converting the video data to the data of a second type includes converting the video data to the data of the second type via a lookup table. The second type of data includes more bits and defines more values than the first type of data. In addition, the step of converting the first type of data to data of a second type includes adding a set of dither bits to each data word of the second type, and the step of dithering the second type of data includes dithering the data word of the second type according to one of a plurality of predetermined dithering logic functions depending on the value of the dither bits.

Optionally, the step of converting the video data to the second data type includes converting the video data to compound data words. The compound data words each include a first set of binary bits and a second set of arbitrarily weighted bits, the first set of binary bits and the second set of arbitrarily weighted bits each including at least one bit. 22. In the example method, the arbitrarily weighted bits include a set of equally weighted bits.

A disclosed example method can also be described as including the steps of providing a display with an array of individual pixels, defining a group of said pixels of said display, temporally dithering data to be written to each pixel of said group to generate a series of values to be asserted on each pixel of said group, and changing the order of at least one of said series of values depending on the location of a pixel of said group upon which said reordered series of values is to be asserted. In other words, the series of values is written to each pixel of the group out of phase with the other pixels of the group, thereby reducing flicker which can sometimes be caused by prior art temporal dithering methods.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art by providing a system and method for driving an image display that more accurately displays intensity values and reduces visual artifacts including, but not limited to, contouring. In the following description, numerous specific details are set forth (e.g., number of pixels in a pixel group, specific data schemes, etc.,) in order to provide a thorough understanding of the invention. Those skilled in the art will recognize, however, that the invention may be practiced apart from these specific details. In other instances, details of well known electronics manufacturing practices (e.g., specific device programming, circuitry layout, timing signals, etc.) and components have been omitted, so as not to unnecessarily obscure the present invention.

Figure 1:
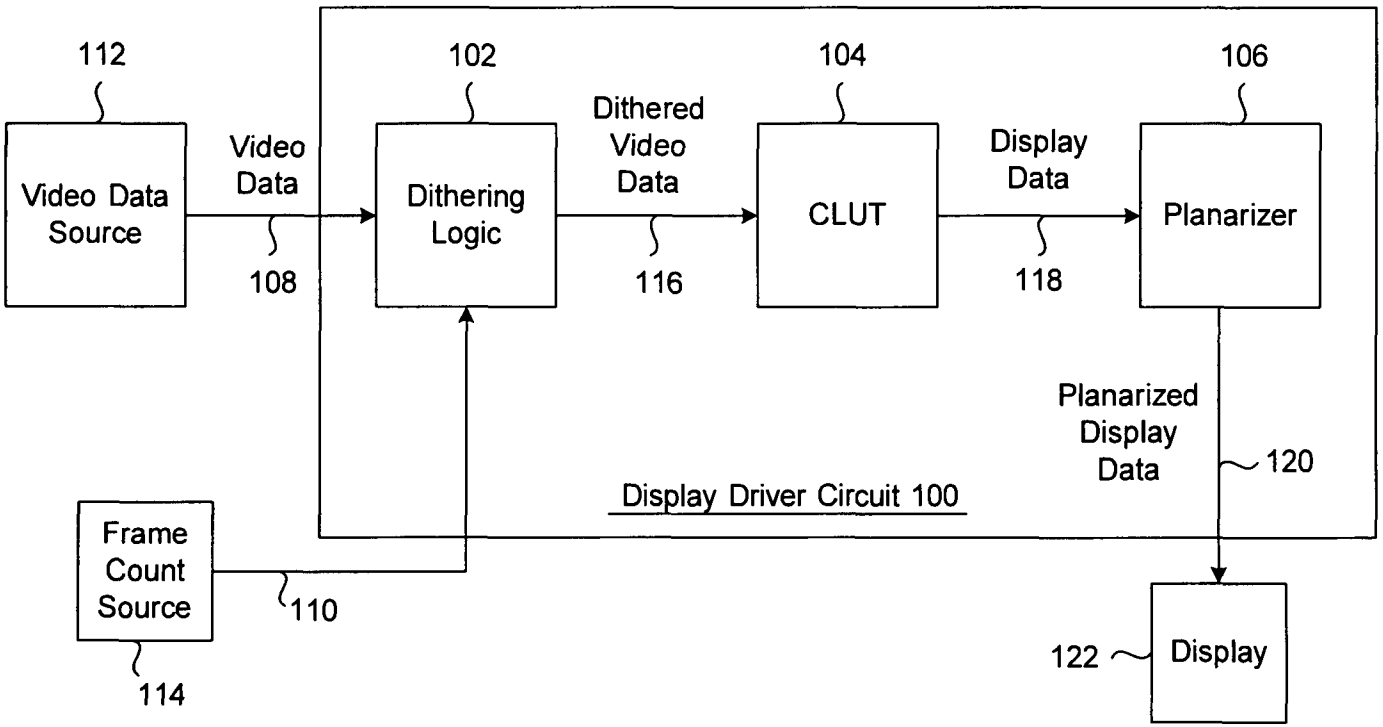
Fig. 1 Prior Art
FIG. 1 is a block diagram showing a prior art display driver circuit.
Figure 2:
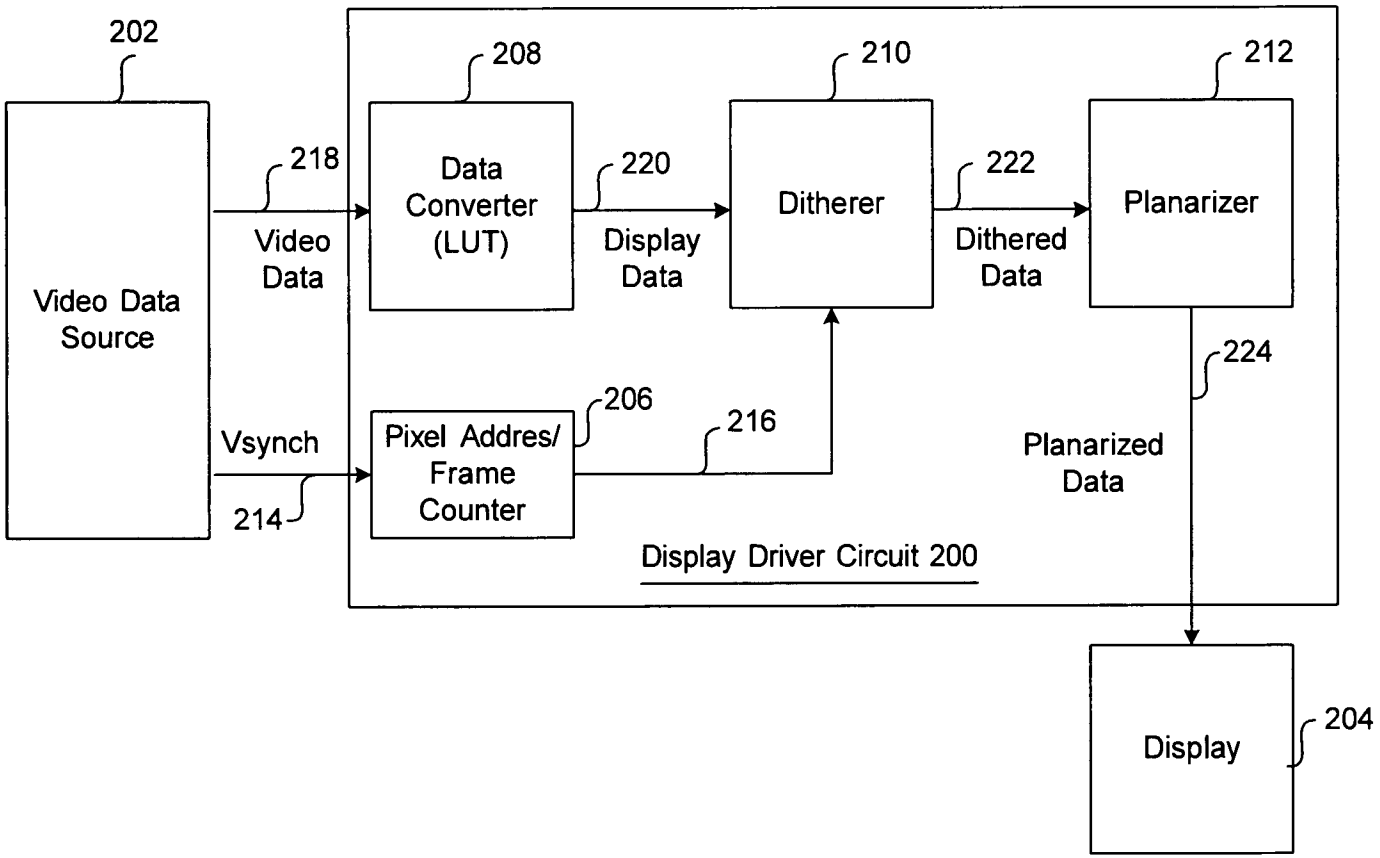
FIG. 2 is a block diagram showing an example embodiment of a display driver circuit according to the present invention.

FIG. 2 is a block diagram showing a display driver circuit 200 coupled between a video data source 202 and a display 204. In this particular embodiment, display driver circuit 200 includes a pixel address/frame counter 206, a data converter (e.g., a look up table) 208, a ditherer 210, and a planarizer 212. Pixel address/frame counter 206 receives a Vsynch signal 214 from video data source 202 and sends a pixel address/frame count signal 216 to ditherer 210. Data converter 208 receives video data 218 from video data source 202 and converts it into display data 220. In particular, data converter 208 receives video data 218 (e.g., 24-bit RGB data) that includes a data word defined by a first number of bits (e.g., an 8-bit binary intensity value for the color red), then uses a lookup table to map the first data word to second data word that includes a greater number of bits than the first data word. Due to the greater number of bits, the second data word is capable of defining a greater number of intensity values than the first data word. Ditherer 210 receives display data 220 and pixel address/frame count signal 216 from data converter 208 and pixel address/frame counter 206, respectively. Ditherer 210 converts display data 220 into dithered data 222, which is provided to planarizer 212. Planarizer 212 planarizes the dithered display data and provides planarized data 224 to display 204 (e.g., an LCD).

Greater accuracy with respect to displayed intensities is achievable, because the incoming video data is converted to a higher resolution data scheme. The particular intensity values are then mapped to particular intensity values of the display data scheme that provide the closest correlation between the actual intensity displayed and the value of the original video data. The primary reason for mapping the video data to a higher resolution data scheme is not to increase the color bit depth of display 204. Rather, increasing the intensity resolution of the display data 220 facilitates a closer matching between the values of the original video data and the actual intensities displayed.

Dithering of the display data 220 (as opposed to dithering of the original video data 218) provides even closer matching between the values of the video data words and the intensities displayed. Because each video data word is converted into a display data word of greater resolution, the LSB (least significant bit) of the display data has a smaller value than the LSB of the video data word. The smaller valued LSBs allow finer adjustments via dithering.

For example, an 8-bit binary data word can define 256 intensity levels, each level corresponding to 1/256 (0.39%) of the full intensity. Temporal dithering data over four frames would facilitate an adjustment of ¼ of 0.39%, or about 0.98%. On the other hand, adding just two additional binary bits to the data word results in a ten-bit data word that can define 1,024 intensity levels, each corresponding to $1/1{,}024$, or about 0.098%, of the full intensity. Temporal dithering of the 10-bit data over four frames would then facilitate an adjustment of ¼ of 0.098%, or about 0.024%.

Although the foregoing example uses data words with binary weighted data bits, it should be understood that the technique can be used with data words including other bit-weighting schemes. For example, data words can include binary-weighted bits, equally-weighted bits, arbitrarily-weighted bits, thermometer bits (sequentially set bits), or any combination thereof. As long as the converted display data defines more intensity values than the original video data, the dithering process can provide finer adjustment of the intensity levels.

In addition to the data conversion that facilitates finer adjustment of intensity values by a dithering process, display artifacts such as contouring can be significantly reduced by a novel dithering technique. The novel dithering technique combines aspects of temporal and spatial dithering, and achieves good results without sacrificing spatial resolution. The new technique, therefore, provides an important advantage over the dithering techniques of the prior art. The new dithering technique will be explained with reference to FIGS. 3-6B.

Figure 3:
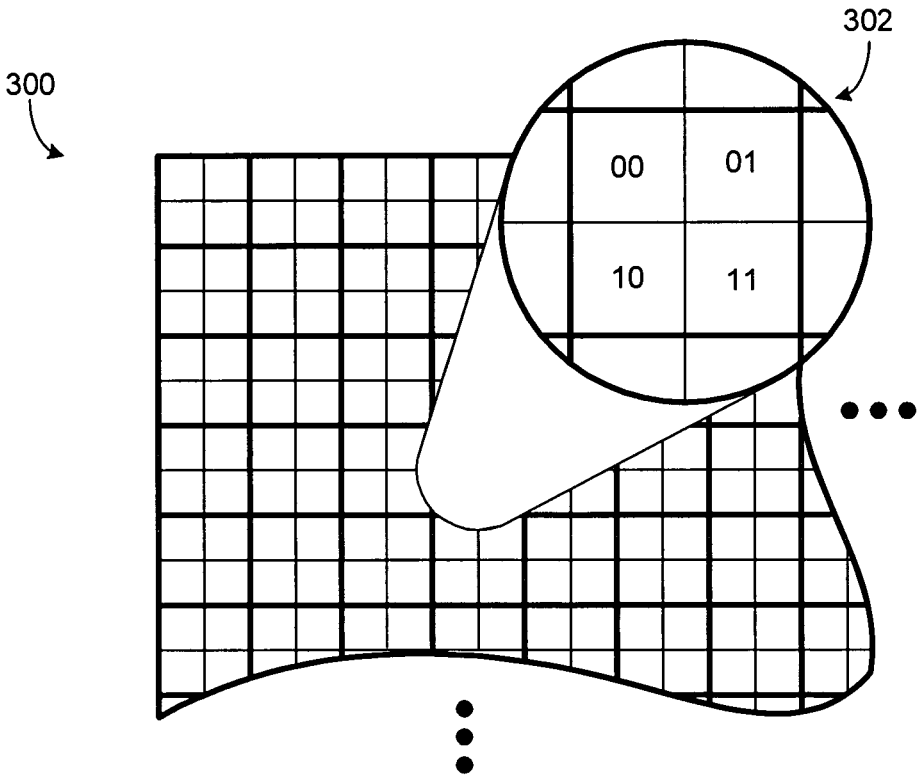
FIG. 3 is a top view of a portion of a pixel array.

FIG. 3 is top (display side) view of a section of a pixel array 300 of display device 204, which is driven by display driver circuit 200. In this particular embodiment, the pixels of pixel array 300 are grouped into pixel groups 302. Each pixel group 302 is defined by four adjacent individual pixels, which are addressed within the group with pixel addresses 00, 01, 10, and 11. As shown, pixel addresses 00, 01, 10, and 11 correspond to the upper left pixel, upper right pixel, lower left pixel, and lower right pixel, respectively. Note that pixel groups that are driven by display driver circuit 200 need not be limited to four pixels. Rather, the pixel groups can include more or less than four pixels. However, the pixels are arranged in groups of four in this example, because the data is dithered over four frames.

Figure 4A:
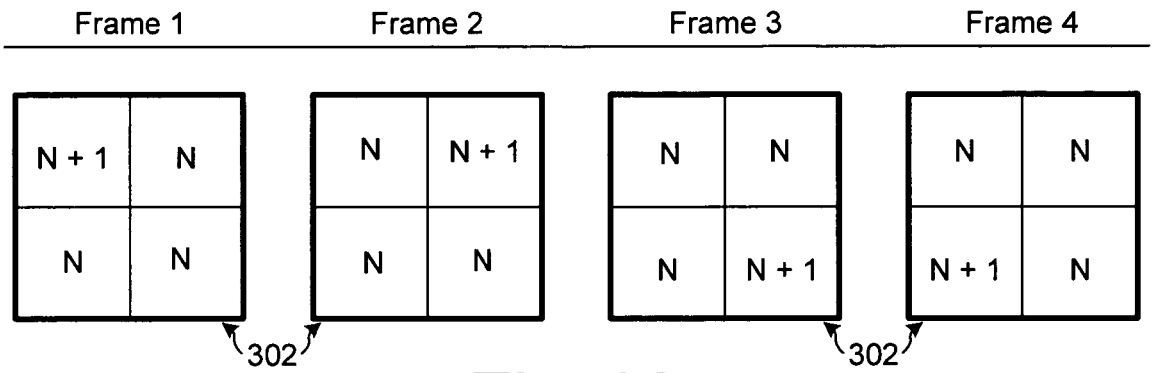
FIG. 4*a* is time sequenced top view of a pixel group showing 1.25×N dithering.

FIG. 4*a* shows data values asserted on the pixels of group 302 during four successive frames, during a dithering process intended to display a intensity of 1.25N. In this particular example, N represents an arbitrary value defined by display data 220 of FIG. 2, and N+1 defines the value attained by adding a single LSB value to the data word defining N. In other words, N and N+1 are adjacent intensity values, with N+1 being the higher value.

Note that the values N and N+1 are asserted on each pixel to properly achieve 1.25N dithering, but not at the same time. During the first frame, N+1 is applied to pixel 00 while N is applied to adjacent pixels 01, 11, and 10. During the second frame N+1 is applied to pixel 01 while N is applied to adjacent pixels 11, 10, and 00. During the third frame, N+1 is applied to pixel 11 while N is applied to adjacent pixels 10, 01, and 01. During the fourth frame, N+1 is applied to pixel 10 while N is applied to adjacent pixels 00, 01, and 11. As a result, each pixel receives the temporally dithered data, so there is no loss of spatial resolution.

This new type of dithering can be considered spatially phase-shifted, temporal dithering. As shown, each pixel receives the same temporally dithered data. However, the sequence in which the data values are asserted on each pixel is offset with respect to the other pixels. The offset is determined by the relative location of the individual pixel.

Figure 4B:
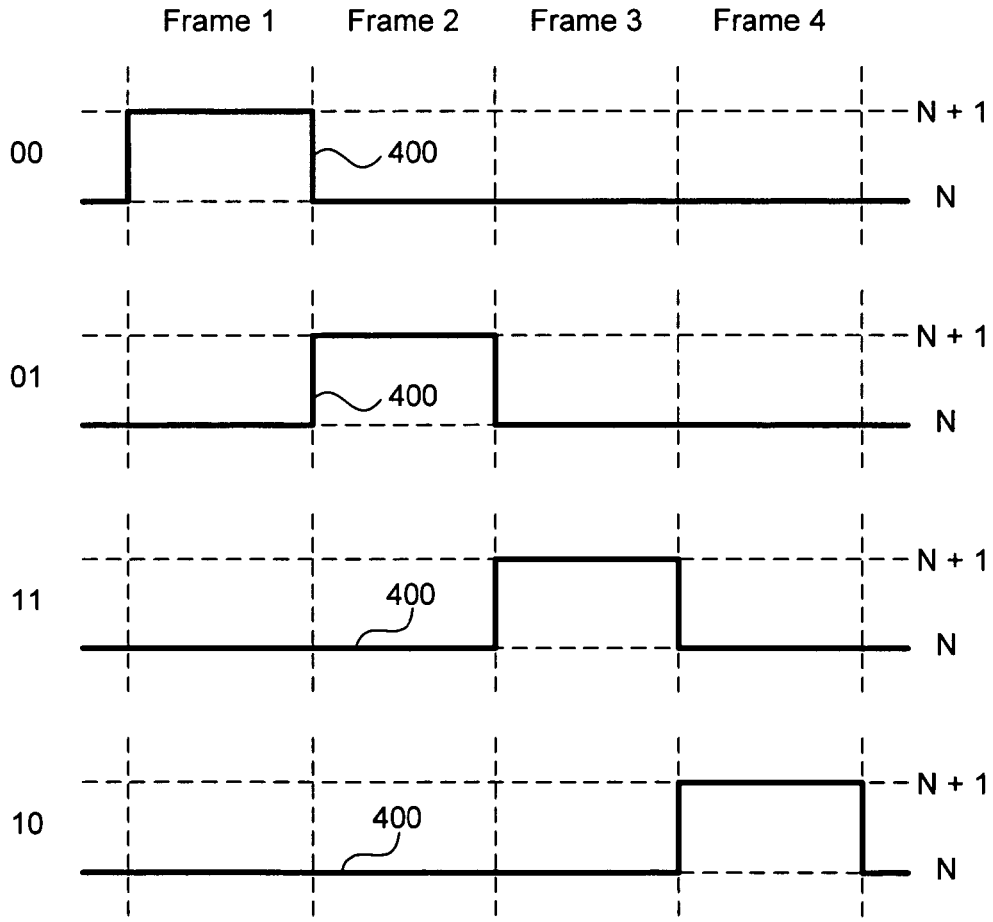
FIG. 4*b* is a timing diagram corresponding to the pixel group of FIG. 4*a;*

FIG. 4B is a timing diagram showing the data value 400 being applied to pixel group 302 over four frames. Note that overall data value 400 is the time averaged intensity over four successive frames. In particular, for each pixel, data value 400 is equal to [(N+1)+3 N]/4.

Diagram 400B includes four rows, each showing corresponding to a different pixel address 00, 01, 11, or 10. During each frame, either value N or N+1 is asserted on each pixel. During the first frame, N+1 is applied to pixel 00, and N is applied to pixels 01, 11, and 10. During the second frame, N+1 is applied to pixel 01, and N is applied to pixels 11, 10, and 00. During the third frame, N+1 is applied to pixel 11, and N is applied to pixels 10, 00, and 01. Finally, during the fourth frame, N+1 is applied to pixel 10, and N is applied to neighboring pixels 00, 01, and 11.

It should be apparent from the view of FIG. 4B that the data value curves 400 for each pixel are the same, albeit time shifted. In particular, the data value curve for each successive pixel is time shifted by one frame.

Figure 5A:
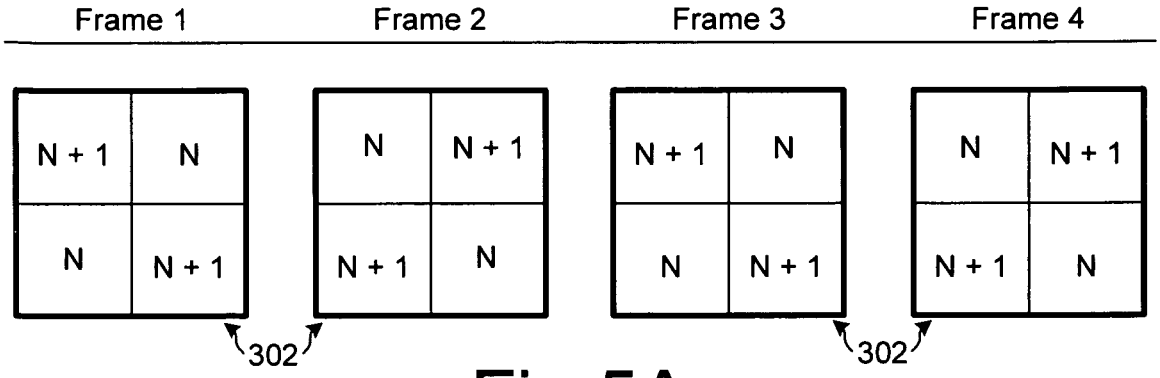
FIG. 5*a* is a time sequenced top view of pixel group showing 1.5×N dithering.
Figure 5B:
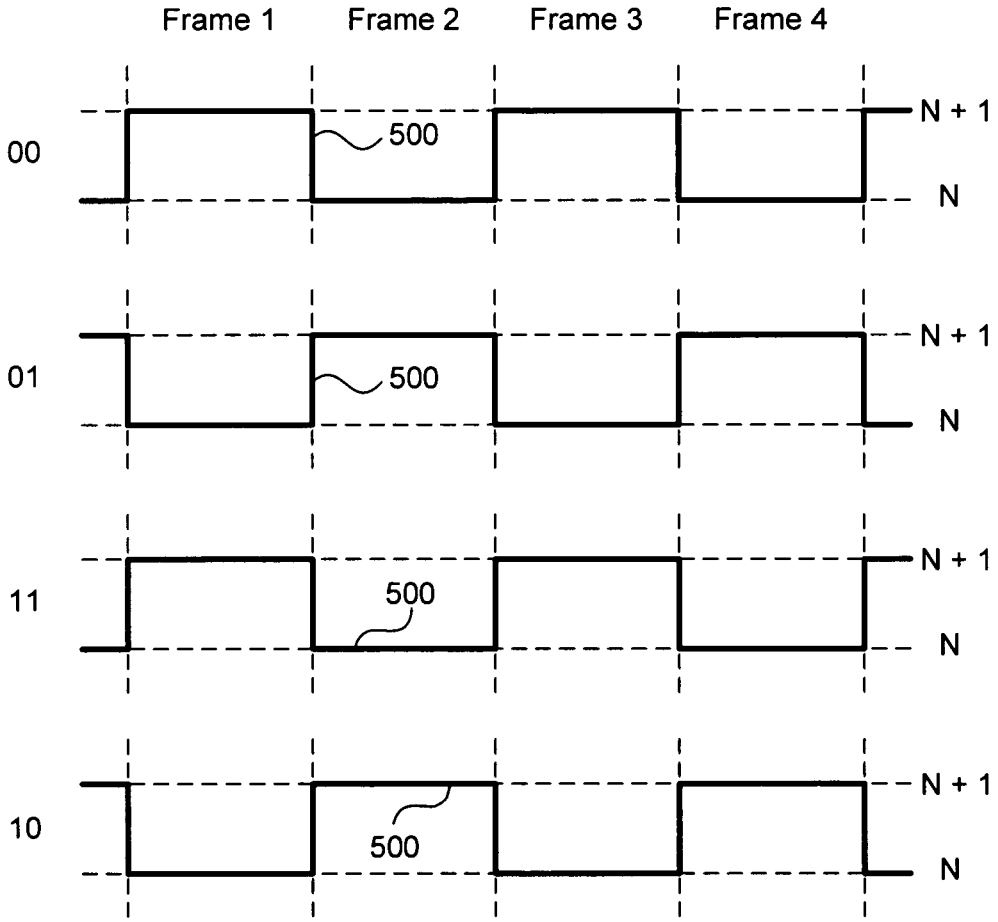
FIG. 5*b* is a timing diagram corresponding to the pixel group of FIG. 5*a;*

FIGS. 5A and 5B are similar to FIGS. 4A and 4B, except that FIGS. 5A and 5B illustrate a dithering pattern intended to display an intensity of 1.5N. An intensity value of 1.5N should result in an intensity midway between values N and N+1. During the first frame, pixels 00 and 11 have the value N+1 asserted thereon, and pixels 10 and 01 have the value N asserted thereon. During the second frame, value N is asserted on pixels 00 and 11, and value N+1 is asserted on pixels 10 and 01. The values asserted during frames 3 and 4 are the same as those asserted during frames 1 and 2, respectively. Comparing the data value curves 500 in FIG. 5B for each pixel, it should be clear that the curves 500 are the same for each pixel, except that the curve 500 for each successive pixel is time shifted to the right by one frame time.

Figure 6A:
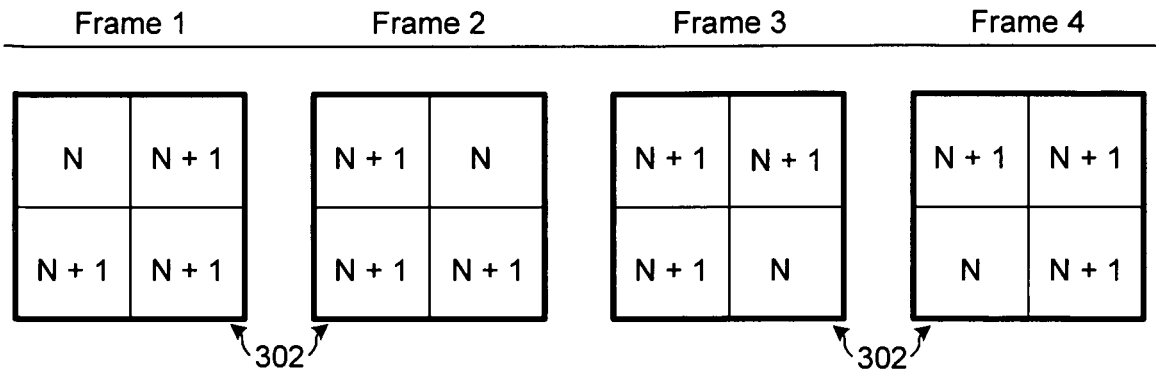
FIG. 6*a* is a time sequenced top view of a pixel group showing 1.75×N dithering.
Figure 6B:
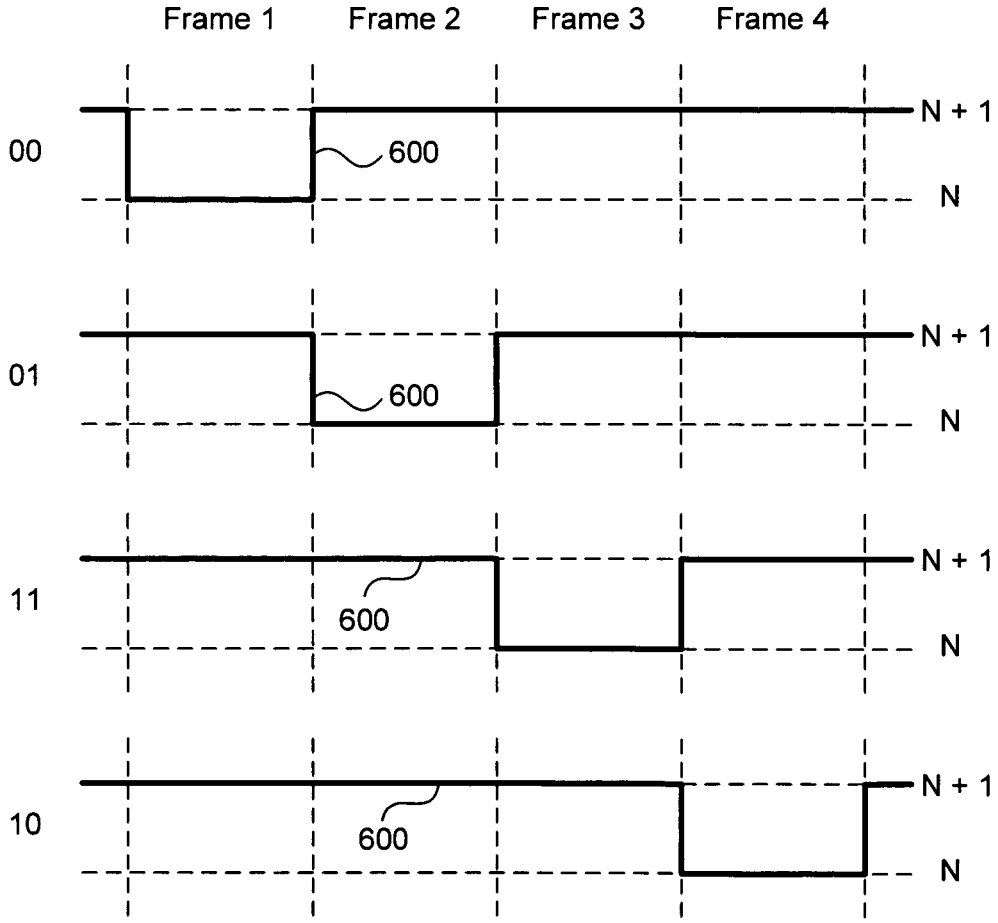
FIG. 6*b* is a timing diagram corresponding to FIG. 6*a;*

FIGS. 6A and 6B are similar to FIGS. 4A and 4B, except that FIGS. 6A and 6B illustrate a dithering pattern intended to display an intensity of 1.75N. During the first frame, value N is asserted on pixel 00, and value N+1 is asserted on pixels 01, 11, and 10. During the second frame, value N+1 is asserted on pixels 00, 11, and 10, and value N is asserted on pixel 01. During the third frame, value N+1 is asserted on pixels 00, 01, and 10, and value N is asserted on pixel 11. During the fourth frame, value N+1 is asserted on pixels 00, 01, and 11, and value N is asserted on pixel 10. Comparing the data value curves 600 in FIG. 6B for each pixel, it should be apparent that the curves 600 are the same for each pixel, except that the curve 600 for each successive pixel is time shifted to the right by one frame time.

Figure 7:
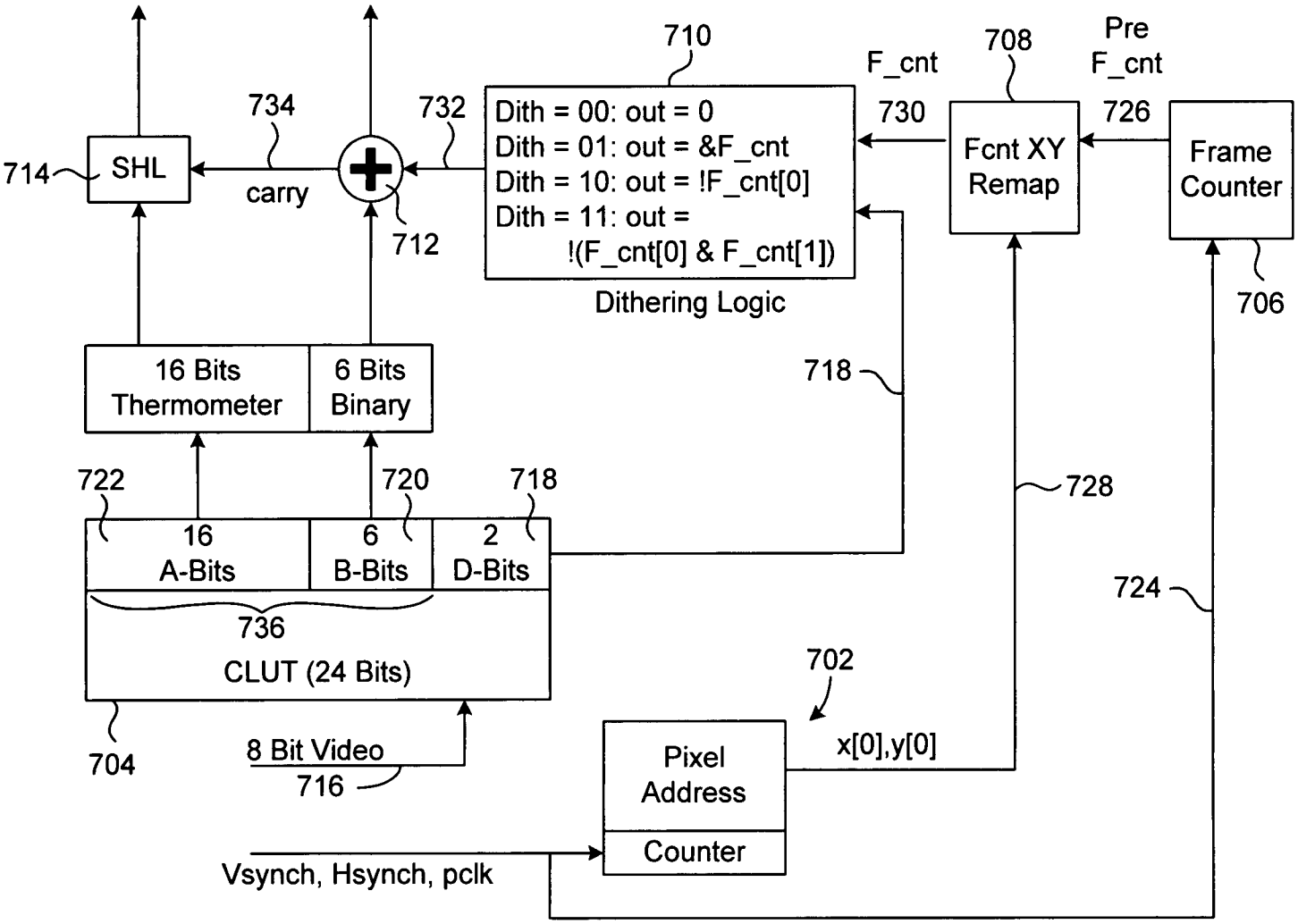
FIG. 7 is an operational block diagram showing an alternate display driver circuit.

FIG. 7 is an operational block diagram of an alternate display driver circuit 700 including: a pixel address/counter 702, a color lookup table (CLUT) 704, a frame counter 706, a frame count remapper 708, dithering logic 710, an adder 712, and a shift-left register 714. In this particular embodiment, CLUT 704 receives 8-bit video data words 716 and converts them to 24-bit data words. The 24-bit data words include two D-bits (dither bits) 718 and a compound data word 736. D-bits 718 are set to select the best dithering scheme for the particular intensity value. Compound data word 736 includes six B-bits (binary bits) 720 and 16 A-bits (arbitrarily weighted bits) 722. The values of B-bits 720 range from an LSB value of $2^0$ to an MSB (most significant bit) value of $2^5$. A-bits 722 are roughly equal in value and have arbitrary weights assigned to yield a particular intensity. In addition, A-bits 722 are "thermometer bits." That is, as intensity values increase, the A-bits are sequentially set high in a predetermined order.

Pixel address/counter 702 receives timing signals 723 (e.g., Vsynch, Hsynch, pclk, etc.) and uses the timing signals 724 to keep track of the pixel address for which each incoming 8-bit data word is destined and provides a group sub-address 728 (00, 01, 10, or 11) to distinguish that pixel from the other three pixels in a four pixel group. The Vsynch signal indicates the start of a new frame of data, the Hsynch signal indicates the start of a new row of data, and the pclk signal indicates each new 8-bit data word. The group sub-address 728 corresponds to the 2-bit pixel addresses shown in FIGS. 3-6B. Frame counter 706 receives timing signals 724 and outputs a pre-frame count 726. In this example embodiment, the value of pre-frame count 726 continuously cycles through four values (00, 01, 10, 11, 00, 01, 10, 11, . . . ), providing one of the four 2-bit addresses for each 8-bit data word. Of course, if the data is to be dithered over more than four frames, frame counter 706 should be adjusted to provide a corresponding output.

Frame count XY remapper 708 receives pre-frame count 726 and group sub-address 728, and then remaps the pre-frame count to a frame count 730, depending on the value of the group sub-address. Thus, remapper 708 facilitates the phase shifting of the temporal dithering depending on the location of a particular pixel within a four-pixel group, as illustrated in FIGS. 4A-6B. In this particular example, the frame count 730 is determined according to the formula F_cnt=3−PreF_cnt−group sub-address. For example, if PreF_cnt is (10) and the group sub-address is (00), then F_cnt=(11)−(10)−(00)=(01). Note that the group sub-address is the least significant bits of the X and Y values of the pixel address.

Dithering logic 710, responsive to the values of both frame count 730 and dither bits 718, outputs a bit to be added to compound data word 736. In particular, dither bits 718 can have one of four possible values, each of which causes dithering logic 710 to implement a respective one of four logic operations. If dither bits 718 have the value 00, dithering logic 710 will output a single bit with a value of 0. If dither bits 718 have the value 01, dithering logic 710 will perform a logical "AND" operation on the bits of frame count 730, then output the single bit result as output bit 732. If dither bits 718 have the value 10, output bit 732 will be set equal to the inverse (i.e., logical "NOT") of the LSB of the frame count 730. If dither bits 718 have the value of 11, dithering logic 710 will perform a logical "AND" operation on the bits of frame count 730 and output the inverse of the result. Thus, if frame count 730 has the value 00, 01, or 10, output bit 732 will be set to 1. If the frame count 730 has the value 11, output bit 732 will be set to 0. The results of the logical operations performed by dithering logic 710 are summarized in the following table, where the frame count values are listed in the top row and the D-bit values are listed in the left most column. A value of N indicates that the value of output bit 732 is 0, and a value of N+1 indicates that the value of output bit 732 is 1.

| | Frame Count Values | | | |
|---|---|---|---|---|
| D-bits | 00 | 01 | 10 | 11 |
| 00 | N | N | N | N |
| 01 | N | N | N | N + 1 |
| 10 | N | N + 1 | N | N + 1 |
| 11 | N + 1 | N + 1 | N + 1 | N |

Output bit 732 is added to compound data word via adder 712 and SHL 714. In particular, adder 712 adds single bit value of 1 or 0 to the six bit binary word defined by B-bits 720. If the summing of B-bits 720 and output bit 732 generates a carry bit 734, then carry bit 734 is added to the thermometer bits via shift left register (SHL) 714. The resulting binary and thermometer bits are then output to subsequent processing circuitry such as a data planarizer.

Figure 8:
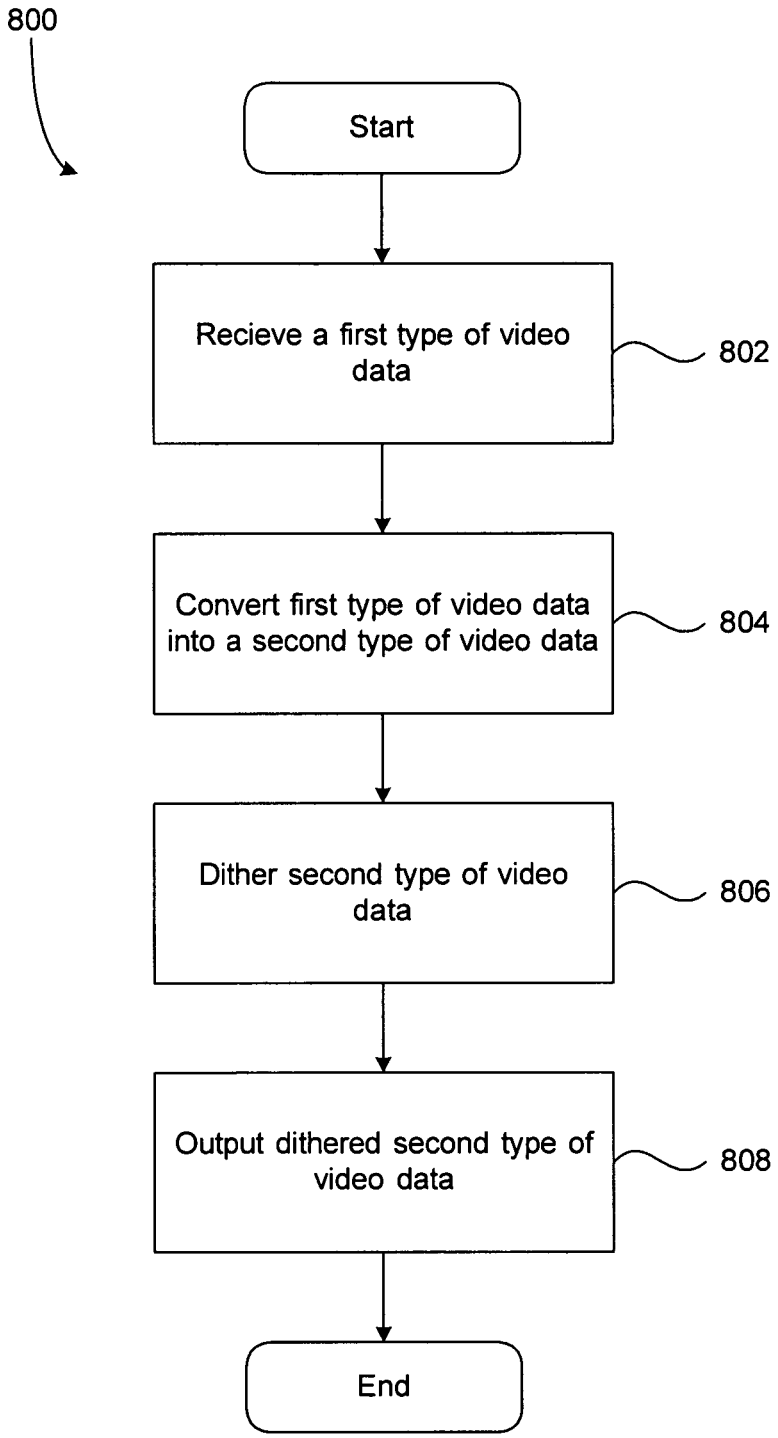
FIG. 8 is a flow chart summarizing one example method for driving a display.

FIG. 8 is a flow chart summarizing one particular method 800 for driving a display. In a first step 802, a first type of video data is received. Then, in a second step 804, the first type of video data is converted into a second type of video data, the second type of video data defining a greater number of intensity values than the first type of video data. Next, in a third step 806, the second type of video data is dithered. Then, in a fourth step 808, the dithered second type of video data is output for display.

The description of particular embodiments of the present invention is now complete. Many of the described features may be substituted, altered or omitted without departing from the scope of the invention. For example, pixel groups of different sizes may be substituted for 2×2 pixel group 302. As another example, data types different than those described can be used with the present invention. As yet another example, the present invention can be implemented with a programmable logic device including a computer-readable storage medium having code embodied therein for causing an electronic device to perform the methods disclosed herein. These and other deviations from the particular embodiments shown will be apparent to those skilled in the art, particularly in view of the foregoing disclosure.

The invention claimed is:

1. A display driver circuit, said circuit including:

an input for receiving video data, said video data including data words having a first number of bits, each data word having a value defining an intensity level to be displayed by an individual pixel;

a data converter coupled to receive said video data and to convert said video data into pixel data to be written to pixels of a display, said pixel data including data words having a second number of bits, said second number of bits being greater than said first number of bits, each data word having a value defining an intensity level to be displayed by an individual pixel; and a ditherer operative to receive said pixel data and to dither said pixel data to generate temporally dithered pixel data, said dithered pixel data including a greater number of bits than said video data.

2. A display driver circuit according to claim 1, wherein:

said video data is capable of defining a first number of said values; and said pixel data is capable of defining a second number of said values, said second number of values being greater than said first number of values.

3. A display driver circuit according to claim 1, wherein:

said video data is binary-weighted video data; and said pixel data includes data words having a group of equally weighted bits.

4. A display driver circuit according to claim 1, wherein said ditherer performs a predetermined dithering function based on at least a portion of said pixel data.

5. A display driver circuit according to claim 1, wherein said data converter includes a look-up-table.

6. A display driver circuit according to claim 1, wherein said ditherer is further operative to generate a series of values to be asserted on corresponding pixels of said display, the order of said values of each said series of values varying depending on the location of said corresponding pixel upon which said series of values is to be asserted.

7. A display driver circuit according to claim 1, wherein:

said video data is data of a first type; and said pixel data is data of a second type different from said first type.

8. A display driver circuit according to claim 7, wherein said first type of data includes a binary data word.

9. A display driver circuit according to claim 7, wherein said second type of data includes a compound data word.

10. A display driver circuit according to claim 9, wherein:

said compound data word includes a first set of binary weighted bits, said first set of bits including at least one bit; and said compound data word includes a second set of arbitrarily weighted bits, said second set of bits including at least one bit.

11. A display driver circuit according to claim 10, wherein said second set of arbitrarily weighted bits includes a set of equally weighted bits.

12. A method for driving a display device, said method comprising:

receiving video data of a first type;

converting said first type of video data to data of a second type different from said first type;

temporally dithering said data of said second type to form dithered pixel data, said dithered pixel data including a greater number of bits than said video data; and outputting said dithered pixel data; and wherein said first type of data is defined by a first data word, said second type of data is defined by a second data word, and said dithered pixel data is defined by said second data word, said first data word having a least significant bit and said second data word having a least significant bit, said least significant bit of said second data word being less significant than said least significant bit of said first data word, said first data word and said second data word each having a value defining an intensity level to be displayed by an individual pixel.

13. A method according to claim 12, wherein said step of receiving said video data includes receiving a binary data word.

14. A method according to claim 12, wherein said step of converting said video data to said data of a second type includes converting said video data to said data of said second type via a lookup table.

15. A method according to claim 12, wherein said second type of data defines more values than said first type of data.

16. A method according to claim 15, wherein:

said first data word is defined by a first number of bits;

said second data word is defined by a second number of bits, and said second number of bits is greater than said first number of bits.

17. A method according to claim 12, wherein said step of converting said first type of video data to said second type includes converting a data word of said video data to a compound data word.

18. A method according to claim 17, wherein:

said step of converting said first type of data to data of a second type includes adding a set of dither bits to said compound data word; and said step of dithering said second type of data includes dithering said second data word according to one of a plurality of predetermined dithering logic functions depending on the value of said dither bits.

19. A method according to claim 17, wherein said compound data word includes a first set of binary bits and a second set of arbitrarily weighted bits, said first set of binary bits and said second set of arbitrarily weighted bits each including at least one bit.

20. A method according to claim 19, wherein said arbitrarily weighted bits include a set of equally weighted bits.

21. A method for driving a display device, said method comprising:

providing a display with an array of individual pixels;

defining a group of said pixels of said display;

temporally dithering data to be written to each pixel of said group to generate a series of values to be asserted on each pixel of said group; and changing the order of at least one of said series of values depending on the location of a pixel of said group upon which said reordered series of values is to be asserted; and wherein said step of temporally dithering data includes receiving digital video data of a first type, said video data of said first type including data words having values defining intensity levels to be displayed by individual pixels, converting said digital video data of said first type to data of a second type, said data of said second type including data words having values defining intensity levels to be displayed on individual pixels and being capable of defining more values than said data words of said data of said first type, and dithering said data of said second type to generate said series of values;

said data of said second type includes a compound data word for each pixel of said group; and said compound data word includes a first set of binary bits and a second set of arbitrarily weighted bits, said first set of binary bits and said second set of arbitrarily weighted bits each including at least one bit.

22. A method according to claim 21, wherein said data words of said data of said second type each include a greater number of bits than said data words of said digital video data.

* * * * *